US012290848B1

(12) United States Patent
Han et al.

(10) Patent No.: US 12,290,848 B1
(45) Date of Patent: May 6, 2025

(54) EFFICIENT PREPARATION METHOD OF BIMETALLIC SEAMLESS COMPOSITE PIPE

(71) Applicant: TAIYUAN UNIVERSITY OF TECHNOLOGY, Taiyuan (CN)

(72) Inventors: Jianchao Han, Taiyuan (CN); Yanjun Wang, Taiyuan (CN); Yi Jia, Taiyuan (CN); Xinlong Zhang, Taiyuan (CN); Wei Zhang, Taiyuan (CN); Yizhi Zhang, Taiyuan (CN); Shuzhi Zhang, Taiyuan (CN); Changjiang Zhang, Taiyuan (CN); Tao Wang, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 0 days.

(21) Appl. No.: 18/768,250

(22) Filed: Jul. 10, 2024

(30) Foreign Application Priority Data

Jan. 9, 2024 (CN) ..... 202410026985.9

(51) Int. Cl.
*B21C 23/22* (2006.01)
*B21C 23/00* (2006.01)
(Continued)

(52) U.S. Cl.
CPC ..... *B21C 23/22* (2013.01); *B21C 23/002* (2013.01); *B21C 29/003* (2013.01); *C21D 1/30* (2013.01)

(58) Field of Classification Search
None
See application file for complete search history.

(56) References Cited

U.S. PATENT DOCUMENTS 4,795,078 A 1/1989 Kuroki et al.
6,283,159 B1 9/2001 Tada
(Continued)

FOREIGN PATENT DOCUMENTS

CN 1374158 A 10/2002
CN 101412047 A 4/2009
(Continued)

OTHER PUBLICATIONS

Kong Chenmei et al., "Analysis on the tearing principle between layers of the cold rolledbi-metal composite pipe," Forging & Stamping Technology, Date of issue: Oct. 31, 2016, p. 142-148, vol. 41, No. 10. Related claims: 1-4.
(Continued)

*Primary Examiner* — George Wyszomierski
*Assistant Examiner* — Janell C Morillo
(74) *Attorney, Agent, or Firm* — Pilloff Passino & Cosenza LLP; Rachel Pilloff; Sean Passino

(57) ABSTRACT

Provided is an efficient preparation method of a bimetallic seamless composite pipe, and belongs to the technical field of steel pipe manufacture. The efficient preparation method of the bimetallic seamless composite pipe includes following steps: sheathing a base pipe blank on a cladding pipe blank to obtain a composite pipe blank, and carrying out a stress relief annealing treatment on the composite pipe blank, where the base pipe blank and the cladding pipe blank are made of different materials; heating the composite pipe blank after the stress relief annealing treatment to a hot working window temperature, and sheathing on a core rod of an extrusion cylinder after an insulation treatment, and then extruding along an axial direction of the extrusion cylinder to obtain a bimetallic seamless composite pipe.

2 Claims, 12 Drawing Sheets

(51) Int. Cl.
*B21C 29/00* (2006.01)
*C21D 1/30* (2006.01)

(56) References Cited

U.S. PATENT DOCUMENTS

| | | | | |
|---|---|---|---|---|
| 7,596,848 | B2 * | 10/2009 | Urech | B23P 11/005 29/516 |
| 2011/0120585 | A1 | 5/2011 | Hur et al. | |
| 2011/0220237 | A1 | 9/2011 | Okamoto | |
| 2011/0290364 | A1 * | 12/2011 | Biris | B21C 23/24 138/140 |
| 2022/0241831 | A1 | 8/2022 | Han et al. | |

FOREIGN PATENT DOCUMENTS

| | | | |
|---|---|---|---|
| CN | 102159337 | A | 8/2011 |
| CN | 103191940 | A | 7/2013 |
| CN | 103934303 | A | 7/2014 |
| CN | 109127772 | A | 1/2019 |
| CN | 109794732 | A | 5/2019 |
| CN | 112439789 | A | 3/2021 |
| CN | 114130844 | A | 3/2022 |
| CN | 116972238 | A | 10/2023 |
| EP | 1541252 | A1 | 6/2005 |
| JP | H09300005 | A | 11/1997 |
| JP | 2000271635 | A | 10/2000 |
| JP | 2011073059 | A | 4/2011 |
| KR | 101392480 | A | 5/2014 |
| MX | 2011002751 | A | 9/2011 |
| WO | 2020170774 | A1 | 8/2020 |
| WO | 2021078225 | A1 | 4/2021 |

OTHER PUBLICATIONS

Luo Ruixue, "Study on Extrusion Forming Technique for Bimetal-lined Pipe," Hot working technology, Date of issue : Jul. 10. 2010, p. 87-89, vol. 39, No. 13. Related claims: 1-4.

Chen Wang et al., "Study of Copper/Aluminum Bimetallic Tube Rotary Ring Spinning Composite Forming Characteristics," Appl. Sci., Date of issue: Apr. 9, 2023, p. 1-13 Related claims: 1-4.

Ye Tian et al., "A novel severe plastic deformation method for manufacturing Al/Mg bimetallic tube," Int J Adv Manuf Technol., Date of issue: Dec. 31, 2021, pp. 2569-2575 Related claims: 1-4.

Gu Xia et al., "Rolling Plastic Forming Technology and Experimental Investigation for Bimetallic Composite Tube," China Heavy Equipment, Date of issue: Sep. 30, 2011, p. 41-43, Issue 03. Related claims: 1-9.

Chang Yonggang et al., "Production Process Analysis and Quality Control of Bimetal Clad Steel PipeUsed for Oil and Gas Transportation," Welded Pipe, Date of issue: Apr. 28, 2017, p. 49-52, vol. 40, Issue 04. Related claims: 1-9.

Wang Haipeng et al., Experimental Study on Tensile Properties of Adhesive Bonded Components of Composites Pipe—aluminum Joint, Fiber composites, Date of issue: Sep. 15, 2013, p. 27-29, issue 03. Related claims: 1-9.

First Office Action for China Application No. 202410026985.9, mailed Feb. 19, 2024.

Notification to Grant Patent for China Application No. 202410026985.9, mailed Mar. 7, 2024.

First Search Report for China Application No. 202410026985.9, dated Feb. 5, 2024.

Supplementary Search Report for China Application No. 202410026985.9, dated Mar. 5, 2024.

* cited by examiner

EFFICIENT PREPARATION METHOD OF BIMETALLIC SEAMLESS COMPOSITE PIPE

CROSS-REFERENCE TO RELATED APPLICATIONS

This application claims priority to Chinese Patent Application No. 202410026985.9, filed on Jan. 9, 2024, the contents of which are hereby incorporated by reference.

TECHNICAL FIELD

The disclosure relates to the technical field of steel pipe manufacturing, and in particular to an efficient preparation method of a bimetallic seamless composite pipe.

BACKGROUND

Metal pipes are widely used in petrochemical industry, marine ships, aerospace, energy transportation, architectural decoration and other fields because of excellent corrosion resistance, high temperature resistance and impact resistance. However, with the rapid development of modern industry, the service state of materials is facing more and more severe challenges. At present, the performance of single metal pipe is facing the dilemma of bottleneck. Although the performance of single metal pipe may be improved by adding expensive rare metal elements, the improvement range is very limited, and rare metal elements may not be used in industrial production in large quantities.

Bimetallic seamless composite pipe is a new type of pipe, which makes two layers of metal pipes of base pipe and cladding pipe mechanically mesh or metallurgically combine through special processing technology or smelting casting. Bimetallic seamless composite pipe may have excellent properties of the two metals at the same time, and may have characteristics of high specific strength, specific stiffness, oxidation resistance, wear resistance and corrosion resistance. According to different service environments of the base pipe and cladding pipe of the bimetallic seamless composite pipe, selecting materials of the base pipe and cladding pipe reasonably may reduce the addition of expensive metal elements in the production process of single metal pipe and reduce the production cost.

At present, the production processes of bimetallic seamless composite pipe mainly include explosive cladding, hydraulic expansion cladding, rolling cladding and hot extrusion cladding, etc. However, due to the constraints of cladding processes and mechanical equipment, the combination uniformity and length of the composite pipe are limited to some extent, so it is impossible to produce seamless composite pipe with high efficiency and high quality. In explosive cladding, two pipes may be metallurgically bonded due to the shock wave and high temperature and high energy generated by the explosion, but the use of explosives requires operators to have enough experience reserves and high technical conditions, which is dangerous to some extent. The gas and noise produced during the explosion will cause serious pollution to the environment. Moreover, the shock wave generated in the explosion process will make the wall of the composite pipe produce corrugated shape, thereby affecting the uniformity of the combination of the two pipes. Hydraulic expansion is to apply a certain force to the cladding pipe to make it expand. After the force is removed, the cladding pipe and the base pipe engage mechanically, but due to the limitation of mechanical size, the length of the prepared alloy pipe is limited. Rolling cladding may be divided into cold rolling cladding, warm rolling cladding and hot rolling cladding according to different rolling temperatures, but cold rolling cladding may only produce mechanical meshing, which will lead to defects such as uneven wall thickness and low interface strength. Because the rolling equipment is in an open space, the rolling temperature of hot rolling cladding and warm rolling cladding may not be guaranteed. During the rolling process, one end rolled first may produce metallurgical bonding under high temperature and high pressure. However, due to the decrease in temperature, it is difficult for the later rolled part to meet the metallurgical bonding conditions, resulting in uneven bonding force in the rolling direction, greatly limiting the length and bonding force of the rolled pipe fittings. Hot extrusion method is a metallurgical bonding process that occurs between the base pipe and the cladding pipe under the high temperature and triaxial compressive stress of the press. The large compressive stress may also cause shrinkage and pore closure during the casting process, thereby reducing casting defects. The annular force provided by the extrusion cylinder may improve the uniformity of the bonding force of the composite pipe. In addition, the use of extruder may effectively reduce the limitation of mechanical level on the length of composite pipe.

There are generally two methods to produce bimetallic composite pipe blanks by hot extrusion. One is direct centrifugal casting composite pipe blank. The other is to cast a solid ingot and then produce a base pipe blank and a cladding pipe blank by hydraulic punching or machining, and then assemble the two pipe blanks after grinding to produce a composite pipe blank. The composite pipe blank produced by centrifugal casting requires not only the similar melting points of the two materials, but also some experience in the timing of adding molten metal in the inner layer. Adding molten metal too early or too late may cause defects such as cold insulation, inclusion, porosity and looseness between the two pipe blanks, thus reducing the interface quality of composite pipe and seriously affecting the bonding strength and uniformity of composite pipe. Using common casting and machining methods to prepare composite pipe blanks may not only reduce the complexity of centrifugal casting process, but also effectively improve the consistency of performance of the same batch of composite pipe blanks. However, the general assembly method of parallel assembly of base pipe blank and cladding pipe blank is easy to cause the problem that cladding pipe blank is extruded in advance. In addition, the parallel assembly method may not produce bimetallic seamless composite pipe with a large extrusion ratio, which limits the length of composite pipe to a certain extent and reduces the production efficiency. Therefore, how to assemble the blank of composite pipe reasonably and improve the production efficiency of bimetallic seamless composite pipe has become a technical bottleneck to be broken through urgently.

SUMMARY

An objective of the disclosure is to provide an efficient preparation method of a bimetallic seamless composite pipe, so as to solve the problems existing in the prior art. The method according to the disclosure avoids the complexity of preparing the composite pipe blank by centrifugal casting, simplifies the preparation method of the composite pipe blank, improves a binding force between pipe surfaces of a base pipe and a cladding pipe of the composite pipe, and greatly improves a length of the composite pipe.

In order to achieve the above objective, the disclosure provides a following scheme.

One of technical schemes of the disclosure is an efficient preparation method of a bimetallic seamless composite pipe, including following steps.

(1) According to needs, two metal materials (one as a base pipe blank and an other as a cladding pipe blank) with different materials are selected, and the two metal materials with different materials need to have similar hot working window temperatures to ensure that a difference between the hot working window temperatures is within 100° C., so as to have similar thermal deformation resistance at a same temperature.

The similar thermal deformation resistance may ensure that a flow law of the two metals is consistent with a flow law of a single metal seamless pipe during extrusion.

A production process of the pipe blank according to the disclosure is as follows: firstly, an ingot is produced by ordinary sand casting or metal mold casting, and then the base pipe blank and the cladding pipe blank are produced by machining methods such as punching and turning, so that a bimetallic seamless composite pipe blank with a large melting point difference but similar deformation resistance may be prepared, such as bimetallic seamless composite pipes such as copper aluminum, magnesium aluminum and the like.

In an embodiment, a material of the base pipe blank is a metal material such as 6061 aluminum alloy or 5052 aluminum alloy. A material of the cladding pipe blank is a metal material such as 1060 aluminum alloy, AZ31B magnesium alloy or T2 copper.

(2) According to an inner diameter $D_1$ of an extrusion cylinder, cylindrical blanks with a suitable diameter $D_0$ (an outer diameter of a composite pipe blank) is selected for machining. A selection rule is $D_0=D_1-(0.3\text{-}10)$ millimetre (mm), a lower limit is 0.3 mm for a small extruder, an upper limit is 10 mm for a large extruder, and units of $D_1$ and $D_0$ are mm.

(3) According to a diameter of a core rod, the base pipe blank and the cladding pipe blank are pre-drilled in the middles and machined by turning outer surfaces. The diameter of the core rod is $D_2$, an inner diameter of the composite pipe blank is $d_0$, and $d_0=D_2+(1\text{-}3)$ mm, then a pre-drilled hole size is $D_2-(2\text{-}10)$ mm (the pre-drilled hole size is smaller than the diameter of the core rod in order to leave enough materials for further machining), and a lower limit is selected for a small-sized core rod, and an upper limit is selected for a large-sized core rod, and a machining tolerance meets the GB/T 1800.1-2020 IT12 grade, and units of $D_2$ and $d_0$ are mm.

(4) According to different models of the used extruder and die sizes, a diameter of a female die outlet and a diameter of a male die core rod of an extrusion die, a diameter of an inner wall of the extrusion cylinder, heights of the selected blanks and diameters of the selected blanks are measured respectively to obtain required three-dimensional data, and three-dimensional modeling of extrusion related components is carried out. A main process of the three-dimensional modeling includes drawing two-dimensional sketches according to data obtained from physical objects, and then rotating and stretching the sketches to obtain three-dimensional modeling of corresponding objects respectively, and finally combining the components after modeling according to actual working conditions, and using a combined three-dimensional model to simulate the extrusion of a single metal pipe. Materials used for the extrusion simulation of the single metal pipe are selected as materials with weak fluidity, for example AZ31 magnesium alloy is selected as a simulation material for 6061 aluminum alloy and AZ31 magnesium alloy composite. According to results of the extrusion simulation, flow paths of metals at different positions in the extrusion process are analyzed, and a shape of an assembly interface between the base pipe blank and the cladding pipe blank is determined according to the flow law of the metals during extrusion.

A modeling accuracy is mainly determined by an accuracy of the die size, thereby determining the flow paths of the metals. According to different cross-sectional shapes of dies, the dies may be divided into flat die, cone die and streamline die, etc. Different die shapes correspond to different metal flow paths, and corresponding flow paths may be determined according to a simulation software.

In an embodiment, an outer contour of the cladding pipe blank is processed from a big end to a small end in transition, an outer diameter of the big end is 1.5-2.6 times an outer diameter of the small end, and an inner contour of the cladding pipe blank is cylindrical. An outer contour of the base pipe blank is cylindrical, an inner contour is matched with the outer contour of the cladding pipe blank, and there is a gap of 0.05 mm between the inner contour of the base pipe blank and the outer contour of the cladding pipe blank.

In an embodiment, a connecting line from the big end to the small end of a cross section of the cladding pipe blank has a convex curve structure.

(5) According to a wall thickness $b_1$ of a base pipe and a wall thickness $b_2$ of a cladding pipe after forming, and a elastic modulus difference $E_2-E_1$ between materials of the cladding pipe and the base pipe, a pipe blank thickness $b_{03}$ of a determined wall thickness area of the cladding pipe blank is calculated, where $b_{03}=b_2+K$, and K is a supplementary wall thickness of the cladding pipe blank. When $E_2-E_1<-10$ GPa, K=0.5-1 mm; when $-10$ GPa$\leq E_2-E_1\leq 0$ GPa, K=0.2-0.5 mm; and when $E_2-E_1>0$ GPa, K=0-0.2 mm. Units of $b_1$, $b_2$, $b_{03}$ and K are mm, and the units of $E_1$ and $E_2$ are GPa.

(6) According to a metal flow curve in the extrusion process obtained in the (4), an interface shape between the base pipe blank and the cladding pipe blank from the big end to the small end in the machining process is determined, and a bored hollow ingot is further machined according to a wall thickness dimension of the small end calculated in the (5). An end thickness of a non-determined wall thickness area of the base pipe blank (a minimum wall thickness of the base pipe blank) is $b_{01}$, an end thickness of a non-determined wall thickness area of the cladding pipe blank (a maximum wall thickness of the cladding pipe blank) is $b_{02}$, where $b_{02}\geq b_{01}$, and the pipe blank thickness of the determined wall thickness area of the cladding pipe blank is $b_{03}$, and a length of the determined wall thickness area is $l_{01}=0.1\ L_0$ mm, and $L_0$ is an original height of the selected cylindrical ingots (a height of the composite pipe blank), and a machining tolerance meets the GB/T 1800.1-2020 IT12 grade, and the units of $b_{01}$, $b_{02}$, $b_{03}$, $l_{01}$ and $L_0$ are mm.

The surface smoothness of the machined base pipe blank and cladding pipe blank meets the Ra0.2 standard of GB/T 1031-2009, that is, a direction of a machining trace may not be distinguished.

(7) Polishing and cleaning: the machined base pipe blank and cladding pipe blank are polished with sandpaper or a grinder with a strip steel thread head to remove oxide scales and impurities existing in the machining process; an air gun is used to blow away residual metal chips on surfaces of the pipe blanks after polishing and cleaning, and the pipe blanks are cleaned with a corresponding cleaning solution to remove chips on the surfaces of the pipe blanks during machining and polishing, sand particles falling off by the sandpaper and lubricating fluid flowing out of the machine.

(8) The polished and cleaned base pipe blank is sheathed on the cladding pipe blank (combined assembly and blank assembly) to obtain a composite pipe blank, and a stress relief annealing treatment is performed on the composite pipe blank.

The stress relief annealing treatment may eliminate the residual stress stored in the materials during machining.

(9) The composite pipe blank after the stress relief annealing treatment is heated to the hot working window temperature, and is sheathed on the core rod of the extrusion cylinder (the composite pipe blank and the core rod are assembled) after an insulation treatment, and then is put into a feed port, and is positioned in an axial direction of the extrusion cylinder by the an ingot feeder for extrusion, thus obtaining a bimetallic seamless composite pipe.

In an embodiment, the hot working window temperature is 0.75-0.95 times of a metal melting point (a melting point of a material with a lower melting point in the base pipe blank and the cladding pipe blank is defined as the metal melting point).

In an embodiment, an outer diameter of the composite pipe blank is defined as Do mm, and an insulation duration is 1.5-2.5 $D_0$ minute (min).

In an embodiment, when $D_0<50$ mm, the insulation duration is 1.5 $D_0$ min; when 50 mm$<D_0<$100 mm, the insulation duration is $(1.5+0.01\times(D_0-50))\times D_0$ min; when $D_0>100$ mm, the insulation duration is 2.5 $D_0$ min.

In an embodiment, a temperature of the extrusion is the same as a temperature of the insulation treatment. An extrusion ratio of the extrusion $\lambda$ is 25, and an extrusion speed is 0.5-10 millimetre/second (mm/s).

In order to ensure the quality of the extruded pipe, extrusion parameters are selected according to characteristics of the selected base pipe blank and cladding pipe blank materials. In aluminum/aluminum composite and aluminum/copper composite, the extrusion speed may be higher, such as 0.5-10 mm/s. In magnesium/aluminum composite, the pipe blank should be extruded at the extrusion speed of 0.5-1 mm/s to prevent scratches and damage on the surface due to the poor deformability of the magnesium alloy, and the pipe blank should be cooled with clear water at 25° C. immediately after extrusion to ensure the performance of the magnesium alloy.

In an embodiment, when assembling the composite pipe blank and the core rod, graphite-based grease or asphalt lubrication is required to be applied on the core rod and the die part, so that the quality of the composite pipe is improved and the demoulding difficulty is reduced.

In an embodiment, when the temperature of the extrusion is high, glass lubricant powder may be sprinkled on a position of the feed port, and when the composite pipe blank rolls down, the glass lubricant melts and adheres to the surface of the pipe blank to play the role of lubrication and insulation.

In an embodiment, an assembly direction of the composite pipe blank and the core rod is that one end of the non-determined wall thickness area contacts with the base of the core rod, and one end of the determined wall thickness area is a free end.

In an embodiment, a discharge end for the extrusion is a side being the small end of the outer contour of the cladding pipe blank.

(An extrusion direction of the composite pipe is that one end of the non-determined wall thickness area is extruded to the free end of the determined wall thickness area).

A main idea of the disclosure is to obtain flow paths of different metal materials in the extrusion process similar to the first quadrant image of tangent function through finite element simulation according to rheological characteristics of different materials, thereby determining the shape of the assembly interface between the base pipe blank and the cladding pipe blank to change machining shapes of the blanks to assemble a blank, further achieving high-efficiency and high-quality seamless pipe forming. Moreover, before determining the shape for assembling the blank, it is necessary to simulate different materials and conduct reasonable production tests. After obtaining stable process parameters, stable production may be achieved.

One of technical schemes of the disclosure is a bimetallic seamless composite pipe prepared by the preparation method.

One of technical schemes of the disclosure is an application of the bimetallic seamless composite pipe in the fields of aerospace, energy transportation, petrochemical industry or nuclear power.

The disclosure discloses following technical effects.

(1) The method according to the disclosure avoids the complexity of preparing the composite pipe blank by centrifugal casting, simplifies the preparation method of the composite pipe blank, improves the binding force between the pipe surfaces of the base pipe and the cladding pipe of the composite pipe, and greatly improves the length of the composite pipe.

(2) A pipe blank assembly mode according to the disclosure is designed according to flow directions and flow velocities of a core metal (cladding pipe blank) and an edge metal (base pipe blank) in the extrusion process, thus effectively solving a problem that the cladding pipe blank moves ahead of time due to the traditional parallel cooperation of the base pipe blank and the cladding pipe blank, and providing an additional pressing force at a contact interface between the base pipe blank and the cladding pipe blank.

(3) According to the disclosure, the composite pipe is mainly produced by a hot extrusion process, so that the base pipe and the cladding pipe may be metallurgically bonded under an action of high pressure and high temperature, so that the base pipe and the cladding pipe may be bonded at an atomic level and have a good interface bonding ability, and may be subjected to subsequent machining, welding, etc., and a failure mode of peeling between the base pipe and the cladding pipe is less likely to occur than mechanical meshing at extreme temperature (a bonding force of mechanical meshing is generally below 30 megapascal (MPa), and a bonding force according to the disclosure is above 90 MPa).

(4) In the hot extrusion process, the disclosure may reach a larger extrusion ratio, so that a longer bimetallic composite pipe may be produced with less pipe blank materials. Compared with the extrusion mode of composite pipes assembled in parallel, the larger extrusion ratio may improve the conversion rate of pipe blanks to pipes and the production efficiency of pipes per unit time.

(5) A unique blank assembly method according to the disclosure may provide an additional pressing force, so that the interface of the extruded composite pipe has stronger bonding strength. In addition, the blank assembly is carried out according to flow modes of different metals in the extrusion process, so that the metal flow at the bonding interface may be more uniform. Moreover, a longer bimetallic seamless composite pipe may be extruded with a larger extrusion ratio. The method according to the disclosure has advantages of simple and convenient preparation process, low technological difficulty and high production efficiency.

BRIEF DESCRIPTION OF THE DRAWINGS

In order to explain technical schemes of the present disclosure or technical schemes in the prior art more clearly, drawings needed in embodiments are briefly introduced below. Obviously, the drawings in a following description are only some embodiments of the present disclosure. For ordinary people in the field, other drawings may be obtained according to these drawings without paying a creative labor.

DETAILED DESCRIPTION OF THE EMBODIMENTS

Figure 1:
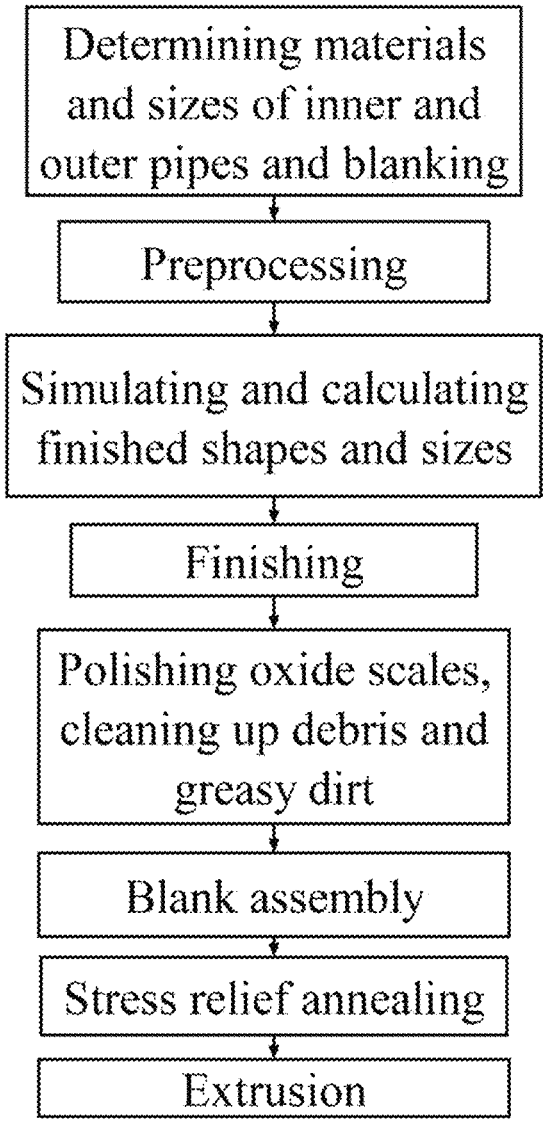
FIG. 1 is a schematic diagram of a preparation process of a bimetallic seamless composite pipe.

A number of exemplary embodiments of the disclosure will now be described in detail, and this detailed description should not be considered as a limitation of the disclosure, but should be understood as a more detailed description of certain aspects, characteristics and embodiments of the disclosure.

It should be understood that terms described in the disclosure are only for describing specific embodiments and are not used to limit the disclosure. In addition, for the numerical range in the disclosure, it should be understood that each intermediate value between the upper limit and the lower limit of the range is also specifically disclosed. The intermediate value within any stated value or stated range and every smaller range between any other stated value or intermediate value within the stated range are also included in the disclosure. The upper limit and lower limit of these smaller ranges may be independently included or excluded from the range.

Unless otherwise specified, all technical and scientific terms used herein have the same meaning as commonly understood by one of ordinary skill in the art to which this disclosure relates. Although the disclosure only describes preferred methods and materials, any methods and materials similar or equivalent to those described herein may also be used in the practice or testing of the disclosure. All literature mentioned in this specification is incorporated by reference to disclose and describe methods and/or materials related to the literature. In case of conflict with any incorporated literature, the contents of this specification shall prevail.

It is obvious to those skilled in the art that many improvements and changes may be made to the specific embodiments of the disclosure without departing from the scope or spirit of the disclosure. Other embodiments will be apparent to the skilled person from the description of the disclosure. The specification and embodiment of this application are only exemplary.

The terms "comprising", "including", "having" and "containing" used in this disclosure are all open terms, which means including but not limited to.

A first aspect of the disclosure provides an efficient preparation method of a bimetallic seamless composite pipe, including following steps.

(1) According to needs, two metal materials with different materials are selected, and the two metal materials with different materials need to have similar hot working window temperatures to ensure that a difference between the hot working window temperatures is within 100° C., so as to have similar thermal deformation resistance at a same temperature.

The similar thermal deformation resistance may ensure that a flow law of the two metals is consistent with a flow law of a single metal seamless pipe during extrusion.

A material of a base pipe blank according to the disclosure is a metal material such as 6061 aluminum alloy or 5052 aluminum alloy. A material of a cladding pipe blank is a metal material such as 1060 aluminum alloy, AZ31B magnesium alloy or T2 copper.

(2) According to an inner diameter $D_1$ of an extrusion cylinder, cylindrical blanks with a suitable diameter $D_0$ are selected for machining. A selection rule is $D_0=D_1-(0.3\text{-}10)$ mm, a lower limit is 0.3 mm for a small extruder, an upper limit is 10 mm for a large extruder, and units of $D_1$ and $D_0$ are mm.

(3) According to a diameter of a core rod, a base pipe blank and a cladding pipe blank are pre-drilled in the middle and machined by turning outer surfaces. The diameter of the core rod is $D_2$, an inner diameter of a composite pipe blank is $d_0$, and $d_0=D_2+(1\text{-}3)$ mm, then a pre-drilled hole size is $D_2-(2\text{-}10)$ mm, and a lower limit is selected for a small-sized core rod, and an upper limit is selected for a large-sized core rod, and a machining tolerance meets the GB/T 1800.1-2020 IT12 grade, and units of $D_2$ and $d_0$ are mm.

(4) According to different models of the used extruder and die sizes, a diameter of a female die outlet and a diameter of a male die core rod of an extrusion die, a diameter of an inner wall of the extrusion cylinder, heights of the selected blanks and diameters of the selected blanks are measured respectively to obtain required three-dimensional data, and three-dimensional modeling of extrusion related components is carried out. A main process of the three-dimensional modeling includes drawing two-dimensional sketches according to data obtained from physical objects, and then rotating and stretching the sketches to obtain three-dimensional modeling of corresponding objects respectively, and finally combining the components after modeling according to actual working conditions, and using a combined three-dimensional model to simulate the extrusion of a single metal pipe. Materials used for the extrusion simulation of the single metal pipe are selected as materials with weak fluidity, for example AZ31 magnesium alloy is selected as a simulation material for 6061 aluminum alloy and AZ31 magnesium alloy composite. According to results of the extrusion simulation, flow paths of metals at different positions in the extrusion process are analyzed, and a shape of an assembly interface between the base pipe blank and the cladding pipe blank is determined according to the flow law of the metals during extrusion.

A modeling accuracy is mainly determined by an accuracy of the die size, thereby determining the flow paths of the metals. According to different cross-sectional shapes of dies, the dies may be divided into flat die, cone die and streamline die, etc. Different die shapes correspond to different metal flow paths, and corresponding flow paths may be determined according to a simulation software.

An outer contour of the cladding pipe blank is processed from a big end to a small end in transition, an outer diameter of the big end is 1.5-2.6 times an outer diameter of the small end, and an inner contour of the cladding pipe blank is cylindrical. An outer contour of the base pipe blank is cylindrical, an inner contour is matched with the outer contour of the cladding pipe blank, and there is a gap of 0.05 mm between the inner contour of the base pipe blank and the outer contour of the cladding pipe blank.

(5) According to a wall thickness $b_1$ of a base pipe and a wall thickness $b_2$ of a cladding pipe after forming, and a elastic modulus difference $E_2-E_1$ between materials of the cladding pipe and the base pipe, a pipe blank thickness $b_{03}$ of a determined wall thickness area of the cladding pipe blank is calculated, where $b_{03}=b_2+K$, and K is a supplementary wall thickness of the cladding pipe blank. When $E_2-E_1<-10$ GPa, K=0.5-1 mm; when $-10$ GPa$\leq E_2-E_1\leq 0$ GPa, K=0.2-0.5 mm; and when $E_2-E_1>0$ GPa, K=0-0.2 mm. Units of $b_1$, $b_2$, $b_{03}$ and K are mm, and the units of $E_1$ and $E_2$ are GPa.

(6) According to a metal flow curve in the extrusion process obtained in the (4), an interface shape between the base pipe blank and the cladding pipe blank from the big end to the small end in the machining process is determined, and a bored hollow ingot is further machined according to a wall thickness dimension of the small end calculated in the (5). An end thickness of a non-determined wall thickness area of the base pipe blank (a minimum wall thickness of the base pipe blank) is $b_{01}$, an end thickness of a non-determined wall thickness area of the cladding pipe blank (a maximum wall thickness of the cladding pipe blank) is $b_{02}$, where $b_{02}\geq b_{01}$, and the pipe blank thickness of the determined wall thickness area of the cladding pipe blank is $b_{03}$, and a length of the determined wall thickness area is $l_{01}=0.1\ L_0$ mm, and $L_0$ is an original height of the selected cylindrical ingots (a height of the composite pipe blank), and a machining tolerance meets the GB/T 1800.1-2020 IT12 grade, and the units of $b_{01}$, $b_{02}$, $b_{03}$, $l_{01}$ and $L_0$ are mm.

A connecting line from the big end to the small end of a cross section of the cladding pipe blank according to the disclosure has a convex curve structure.

The surface smoothness of the machined base pipe blank and cladding pipe blank meets the Ra0.2 standard of GB/T 1031-2009, that is, a direction of a machining trace may not be distinguished.

(7) Polishing and cleaning: the machined base pipe blank and cladding pipe blank are polished with sandpaper or a grinder with a strip steel thread head to remove oxide scales and impurities existing in the machining process; an air gun is used to blow away residual metal chips on surfaces of the pipe blanks after polishing and cleaning, and the pipe blanks are cleaned with a corresponding cleaning solution to remove chips on the surfaces of the pipe blanks during machining and polishing, sand particles falling off by the sandpaper and lubricating fluid flowing out of the machine.

(8) The polished and cleaned base pipe blank is sheathed on the cladding pipe blank (combined assembly) to obtain a composite pipe blank, and a stress relief annealing treatment is performed on the composite pipe blank.

A temperature of the stress relief annealing treatment according to the disclosure is 280-350° C., and a duration is 2 hours (h).

The stress relief annealing treatment may eliminate the residual stress stored in the materials during machining.

(9) The composite pipe blank after the stress relief annealing treatment is heated to the hot working window temperature, and is sheathed on the core rod of the extrusion cylinder (the composite pipe blank and the core rod are assembled) after an insulation treatment, and then is put into a feed port, and is positioned in an axial direction of the extrusion cylinder by the an ingot feeder for extrusion, thus obtaining a bimetallic seamless composite pipe.

The hot working window temperature according to the disclosure is 0.75-0.95 times of a metal melting point (a melting point of a material with a lower melting point in the base pipe blank and the cladding pipe blank is defined as the metal melting point).

When an outer diameter of the composite pipe blank is defined as $D_0$ mm, an insulation duration is 1.5-2.5 $D_0$ min.

In the disclosure, when $D_0<50$ mm, the insulation duration is 1.5 $D_0$ min; when 50 mm$<D_0<$100 mm, the insulation duration is $(1.5+0.01\times(D_0-50))\times D_0$ min; when $D_0>100$ mm, the insulation duration is 2.5 $D_0$ min.

Increasing the outer diameter of the composite pipe blank without increasing the insulation duration will lead to an uneven heating temperature of the composite pipe blank. The rapid cooling in the extrusion process is not conducive to extrusion, and scratches on a surface of an extruded pipe will also cause die loss. Therefore, it is necessary to set the insulation duration according to the change of the outer diameter of the composite pipe blank, so as to ensure the uniformity of heating.

An extrusion temperature according to the disclosure is the same as the temperature of insulation treatment. An extrusion ratio 2 is 25, and an extrusion speed is 0.5-10 mm/s.

Extrusion parameters are selected according to different deformation resistance of the selected base pipe blank and cladding pipe blank materials.

In order to ensure the quality of an extruded pipe, the extrusion parameters are selected according to characteristics of the selected base pipe blank and cladding pipe blank materials. In aluminum/aluminum composite and aluminum/copper composite, because of the good deformability of the two materials, a higher extrusion speed of 5-10 mm/s may be selected. In magnesium/aluminum composite, due to the poor deformability of magnesium alloy, the extrusion should be carried out at the extrusion speed of 0.5-1 mm/s to prevent scratches and damage on the surface, and the extruded pipe should be cooled with clear water at 25° C. immediately after the extrusion to ensure the performance of the magnesium alloy.

When assembling the composite pipe blank and the core rod, graphite-based grease or asphalt lubrication is required to be applied on the core rod and the die part, so that the quality of the composite pipe is improved and the demoulding difficulty is reduced.

When the temperature of the extrusion according to the disclosure is high, glass lubricant powder may be sprinkled on the position of the feed port, so when the composite pipe blank rolls down, the glass lubricant melts and adheres to the surface of the pipe blank to play the role of lubrication and insulation.

An assembly direction of the composite pipe blank and the core rod according to the disclosure is that one end of the non-determined wall thickness area contacts with a base of the core rod, and one end of the determined wall thickness area is a free end.

A discharge end for the extrusion according to the disclosure is a side being the small end of the outer contour of the cladding pipe blank (an extrusion direction of the composite pipe is that one end of the non-determined wall thickness area is extruded to the free end of the determined wall thickness area).

Another aspect of the disclosure provides a bimetallic seamless composite pipe.

Another aspect of the disclosure provides an application of a bimetallic seamless composite pipe in fields of aerospace, energy transportation, petrochemical industry or nuclear power.

Figure 2:
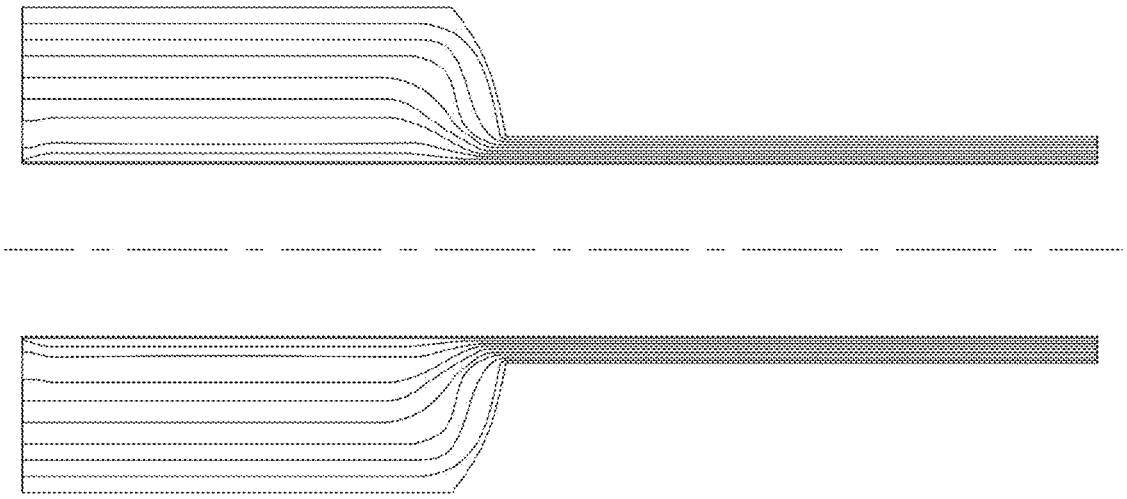
FIG. 2 is a schematic diagram of extruded metal flow of a single metal pipe (6061 aluminum alloy).
Figure 3:
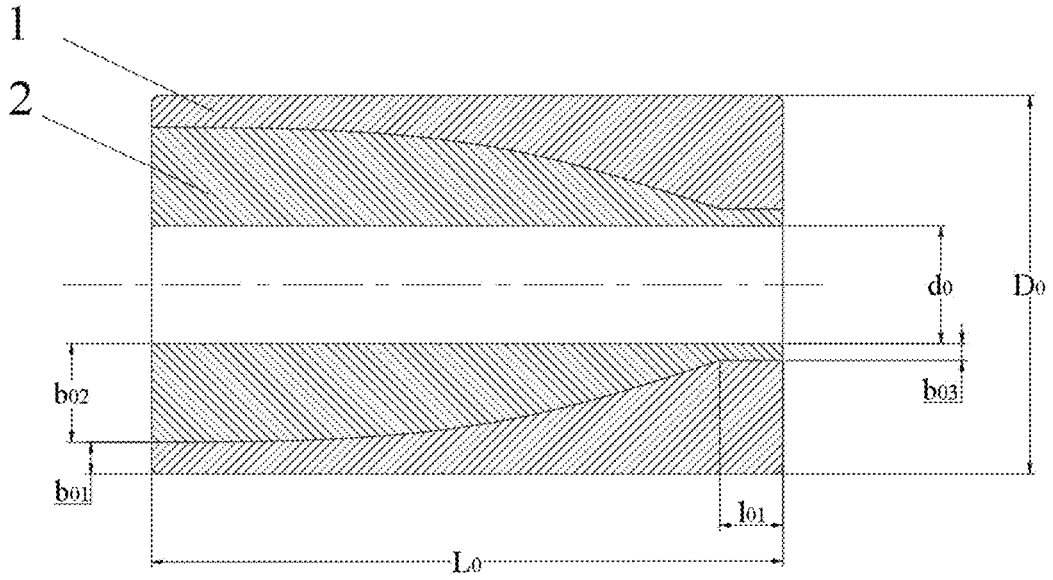
FIG. 3 is a dimension identification diagram of a composite pipe blank.
Figure 4:
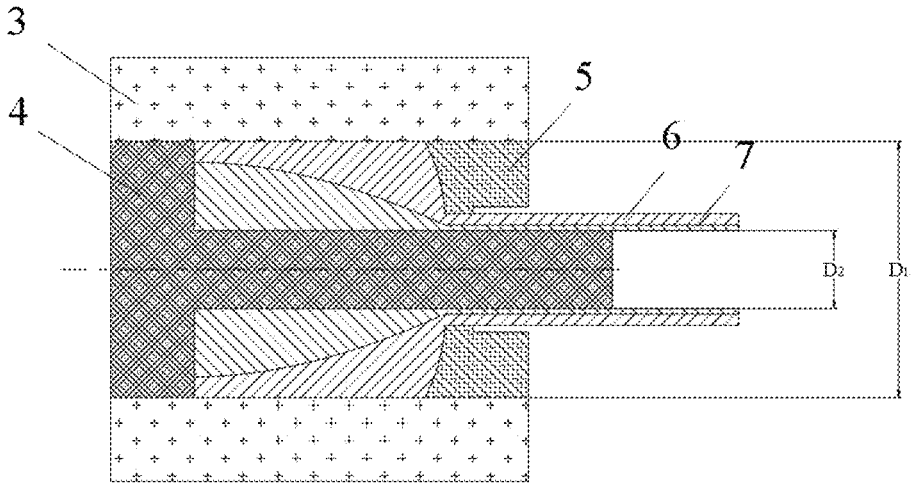
FIG. 4 is a schematic diagram of hot extrusion of the bimetallic seamless composite pipe.

A schematic diagram of a preparation process of the bimetallic seamless composite pipe according to the disclosure is shown in FIG. 1. A schematic diagram of an extruded metal flow of the single metal pipe (6061 aluminum alloy) is shown in FIG. 2. A dimension identification diagram of the composite pipe blank is shown in FIG. 3. A schematic diagram of hot extrusion of the bimetallic seamless composite pipe is shown in FIG. 4. A dimension identification diagram of the bimetallic seamless composite pipe after hot extrusion is shown in FIG. 5.

In FIG. 3, $b_{01}$ is a minimum wall thickness of the base pipe blank of the bimetallic composite pipe, and $b_{02}$ is a maximum wall thickness of the cladding pipe blank of the bimetallic composite pipe; $b_{03}$ is a pipe blank thickness of the determined wall thickness area of the cladding pipe blank, $l_{01}$ is a length of the determined wall thickness area of the cladding pipe blank of the bimetallic composite pipe, $L_0$ is a length of the bimetallic composite pipe blank, $D_0$ is an outer diameter of a bimetallic composite pipe blank, do is an inner diameter of a bimetallic composite pipe blank, 1 is the base pipe blank of the bimetallic composite pipe, and 2 is the cladding pipe blank of the bimetallic composite pipe.

In FIG. 4, 3 is an extrusion cylinder, 4 is an assembly of a core rod and an extrusion pad, 5 is an extrusion die, 6 is a base pipe fitting of the bimetallic composite pipe after hot extrusion, 7 is a cladding pipe fitting of the bimetallic composite pipe after hot extrusion, $D_1$ is an inner diameter of the extrusion cylinder, and $D_2$ is a diameter of the core rod.

Figure 5:
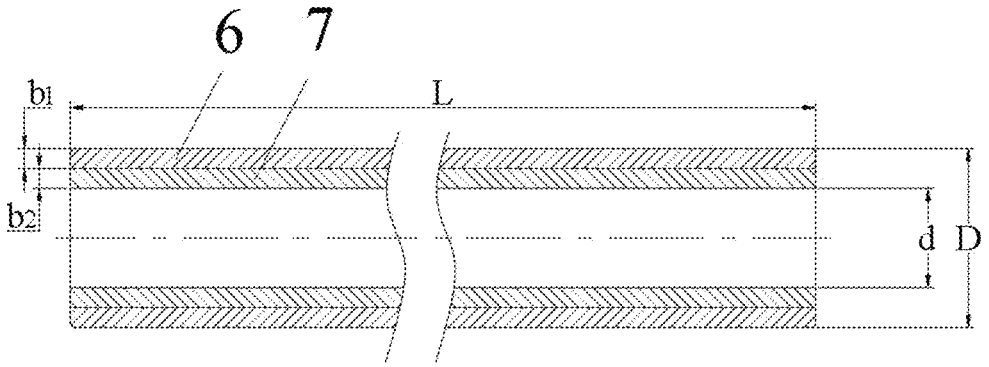
FIG. 5 is a dimension identification diagram of a bimetallic seamless composite pipe after hot extrusion.

In FIG. 5, 6 is the base pipe fitting of the bimetallic composite pipe, 7 is the cladding pipe fitting of the bimetallic composite pipe, L is a length of a bimetallic composite pipe fitting, D is an outer diameter of the bimetallic composite pipe fitting, d is an inner diameter of the bimetallic composite pipe fitting, $b_1$ is a wall thickness of the base pipe fitting of the bimetallic composite pipe, and $b_2$ is a wall thickness of the cladding pipe fitting of the bimetallic composite pipe.

Embodiment 1

An efficient preparation method of 6061 aluminum alloy/1060 aluminum alloy bimetallic seamless metal composite pipe is as follows.

(1) 6061 aluminum alloy is selected as a base pipe blank and 1060 aluminum alloy is selected as a cladding pipe blank. An extruder with an inner diameter of an extrusion cylinder $D_1$=95 mm is selected as extrusion equipment, and a wall thickness of a base pipe of an extruded composite pipe $b_1$=1.4 mm, a wall thickness of a cladding pipe $b_2$=1.1 mm, an elastic modulus $E_1$ of 6061 aluminum alloy (base pipe blank)=68.9 GPa, and an elastic modulus $E_2$ of 1060 aluminum alloy (cladding pipe blank)=71.7 GPa, $E_2-E_1>0$ GPa, and a supplementary wall thickness K=0.2 mm is selected, $b_{03}=b_2+K=1.3$ mm.

(2) According to the inner diameter $D_1$ of the extrusion cylinder, cylindrical blanks of 6061 aluminum alloy and 1060 aluminum alloy with a diameter $D_0$ of 92 mm and an original height $L_0$ of 100 mm are selected.

(3) According to a core rod diameter $D_2$=29.5 mm, centers of 1060 aluminum alloy and 6061 aluminum alloy cylindrical ingots are pre-drilled, with a pre-drilled diameter of 28 mm, a machining error of ±0.21 mm and an aperture deviation of ±0.01 mm, and an outer surface of a 6061 aluminum alloy cylindrical ingot is turned, with a turning depth of 1±0.21 mm and the surface smoothness meeting the Ra0.2 standard of GB/T 1031-2009.

(4) Three-dimensional dimensions of extrusion related components such as extrusion die, extrusion cylinder and extrusion pad are measured, and three-dimensional modeling of the extrusion related components is carried out. Firstly, the inner diameter and the height of the extrusion cylinder are measured as 95 mm and 500 mm, respectively, then the mold, the core rod and the extrusion pad are modeled according to processing engineering drawings of the used mold, the core rod and the extrusion pad, and finally the blanks are modeled according to geometric dimensions of the used extrusion blanks, and three-dimensional models are combined, and the combined three-dimensional model is used to extrude a single metal seamless pipe, and the extrusion blanks are set as deformable bodies, and the rest parts are set as rigid bodies. According to extrusion simulation results, the metal flow situations in the extrusion process, especially flow velocities and flow directions of the core metal and the edge metal, are analyzed, and a shape of an assembly interface between the base pipe blank and the cladding pipe blank is determined to be similar to a first quadrant of a sine curve from a small end to a big end of the cladding pipe.

(5) According to the step (4), the base pipe blank and the cladding pipe blank are further machined (the machining tolerance meets the GB/T 1800.1-2020 IT12 grade, and the surface smoothness meets the Ra0.2 standard of GB/T=1031-2009), where one end of the cladding pipe blank needs to be left with a sufficient length $l_{01}$ (a length of a determined wall thickness area)=0.1 $L_0$ (an original height of the cylindrical ingots)=10 mm, and a pipe blank thickness of the determined wall thickness area of the cladding pipe blank $b_{03}$=1.3 mm, and an outer surface of the cladding pipe blank is machined in the remaining unprocessed area according to the shape determined by the simulation results, and a machined shape is convex from the small end to the big end of the cladding pipe blank. In order to reduce the machining difficulty, a final machined shape is selected to be straight from the small end to the big end of the cladding pipe blank. An end thickness of a non-determined wall thickness area of the base pipe blank (a minimum wall thickness of the base pipe blank of the bimetallic composite pipe) is $b_{01}$=2 mm, and an end thickness of a non-determined wall thickness area of the cladding pipe blank (a maximum wall thickness of the cladding pipe blank of the bimetallic composite pipe) is $b_{02}$=27 mm. An inside of the cladding pipe blank is finely turned according to the core rod diameter $D_2$, and an inner diameter do of the cladding pipe blank is 32 mm, and an inner hole of the base pipe blank is further machined. A machining size is consistent with the outer surface of the cladding pipe (a gap between the base pipe blank and the cladding pipe blank is 0.05 mm). After machining, an outer diameter of the base pipe $D_0$=90 mm, and the machining error is ±0.21 mm.

(6) Polishing: an inner surface of the base pipe blank and the outer surface of the cladding pipe blank are further polished by a grinder with a wire brush, so as to remove residual oxide films on the surfaces and scratches and tiny gullies caused in the machining process, and a surface cleaning thickness is 0.2 mm.

(7) Cleaning: an air gun is used to clean metal chips on the polished surfaces of the pipe blanks, and the pipe blanks are put into alkali liquor for cleaning, so as to remove greasy dirt attached to the surfaces of the pipe blanks during machining.

(8) The base pipe blank and the cladding pipe blank which have been machined, polished and cleaned are assembled to form a bimetallic seamless composite pipe blank.

Figure 6:
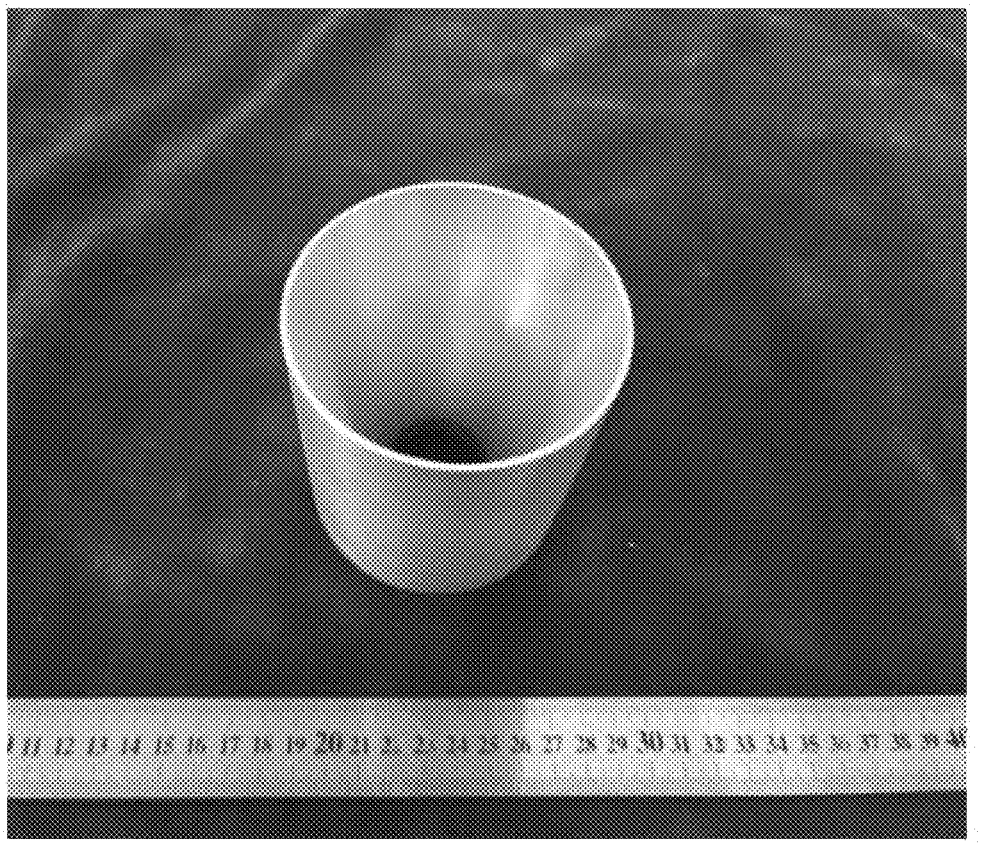
FIG. 6 is a physical diagram of a 6061 aluminum alloy base pipe blank used in Embodiment 1 of the disclosure.
Figure 7:
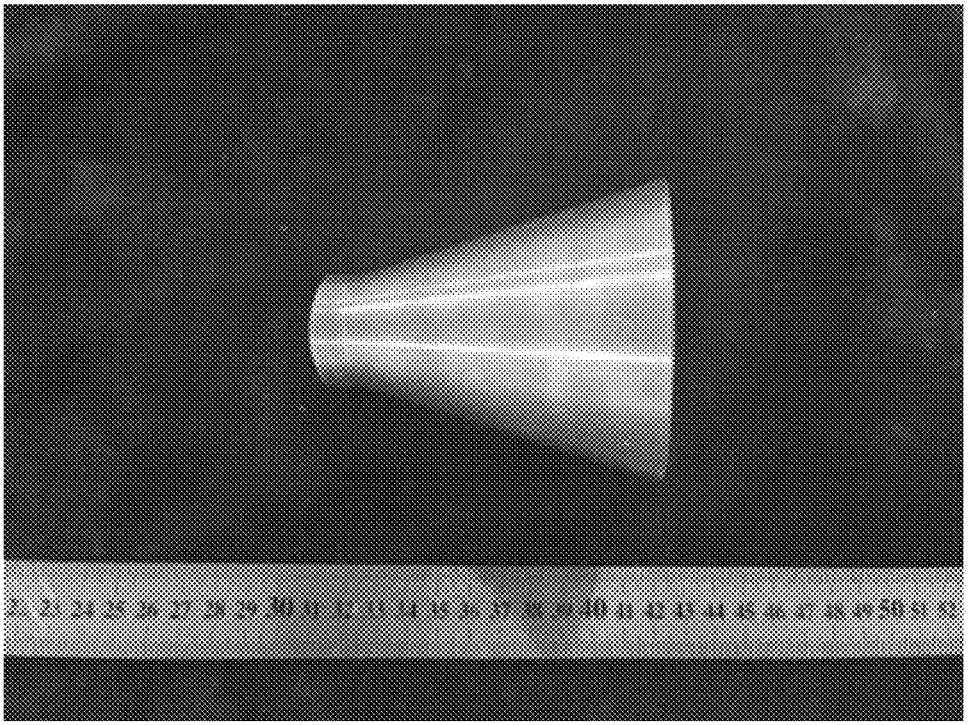
FIG. 7 is a physical diagram of a 1060 aluminum alloy cladding pipe blank used in Embodiment 1 of the disclosure.
Figure 8:
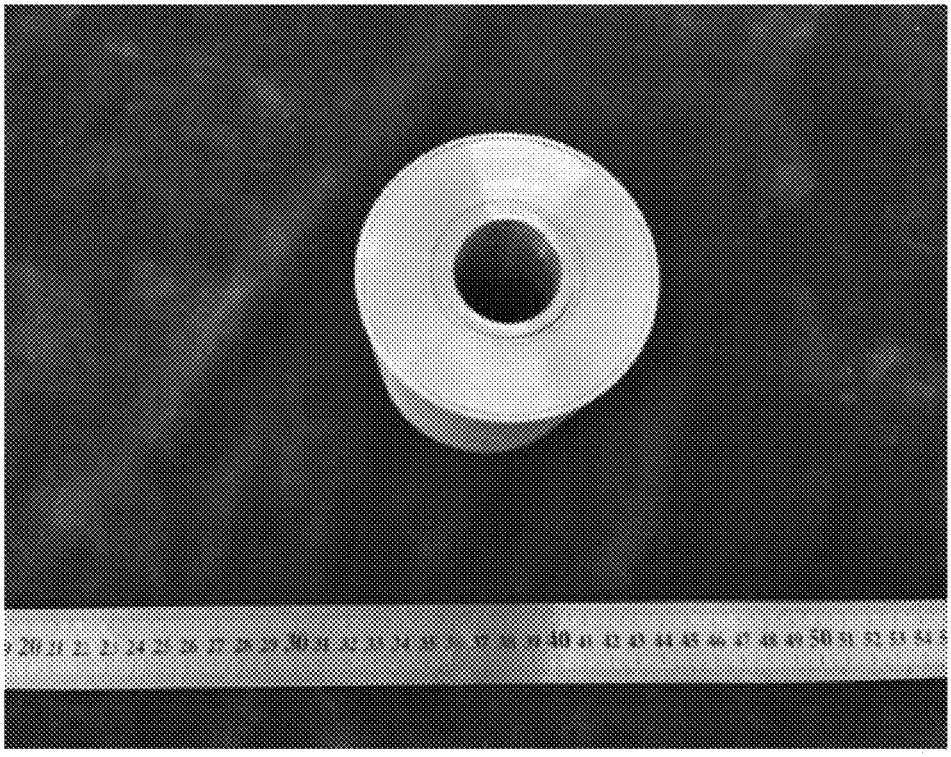
FIG. 8 is a physical diagram of a bimetallic seamless composite pipe blank in Embodiment 1 of the disclosure.

A physical drawing of a 6061 aluminum alloy base pipe blank is shown in FIG. 6. A physical drawing of a 1060 aluminum alloy cladding pipe blank is shown in FIG. 7. A physical diagram of a bimetallic seamless composite pipe blank is shown in FIG. 8.

(9) The bimetallic seamless composite pipe blank obtained in the step (8) is put into a heating furnace for a stress relief annealing treatment, where a temperature of the stress relief annealing treatment is 350° C., and a duration is 2 h, and is cooled after stress relief annealing (cooling mode is furnace cooling) to eliminate an internal stress stored in the composite pipe blank during machining and polishing.

(10) The stress-relieved annealed composite pipe blank is heated and insulated, and a heating temperature is 450° C. (about 0.77 times the melting point of 6061 aluminum alloy (585° C.)), and an insulation duration is $T_1$=177 min ($T_1=(1.5+0.01\times(D_0-50))\times D_0$).

(11) The insulated composite pipe blank is assembled with the core rod, graphite-based grease is coated on the core rod to facilitate the core rod demoulding, a non-determined wall thickness area of the composite pipe blank is in contact with an end of the core rod, and the assembled composite pipe blank and the core rod are put into the extruder for extrusion. During extrusion, a die temperature is 450° C., a maximum extrusion pressure is 20 MPa, an extrusion speed is 2 mm/s, a die hole size is 34.5 mm, and an extrusion ratio $\lambda=(47.5^2-16^2)\div(17.25^2-14.75^2)=25.0$. After extrusion, the assembled composite pipe blank and the core rod are air-cooled to a room temperature, and finally an outer diameter D=34.5 mm, an inner diameter d=29.5 mm, a wall thickness of a base pipe fitting $b_1$=1.4 mm, a wall thickness of a cladding pipe fitting $b_2$=1.4 mm, and a length L of about 170 cm may be obtained (a length L of an extruded bimetallic seamless composite pipe is determined by the original blank length). A conversion rate from blanks to a finished pipe is about 17 times in length.

Figure 9:
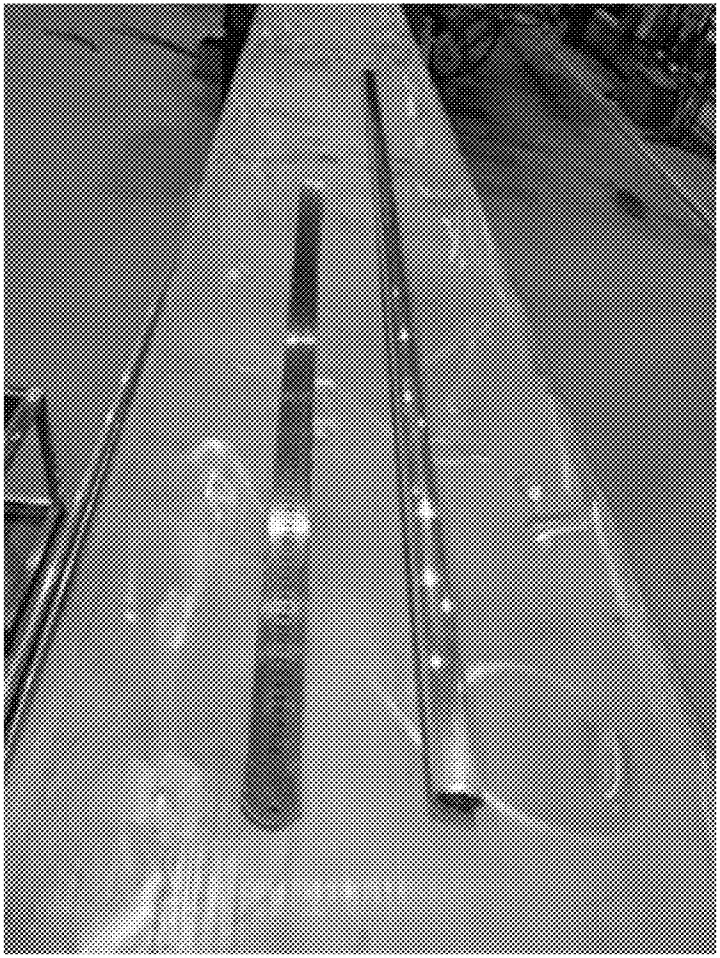
FIG. 9 is a physical diagram of a bimetallic seamless composite pipe prepared in Embodiment 1 of the disclosure.
Figure 10:
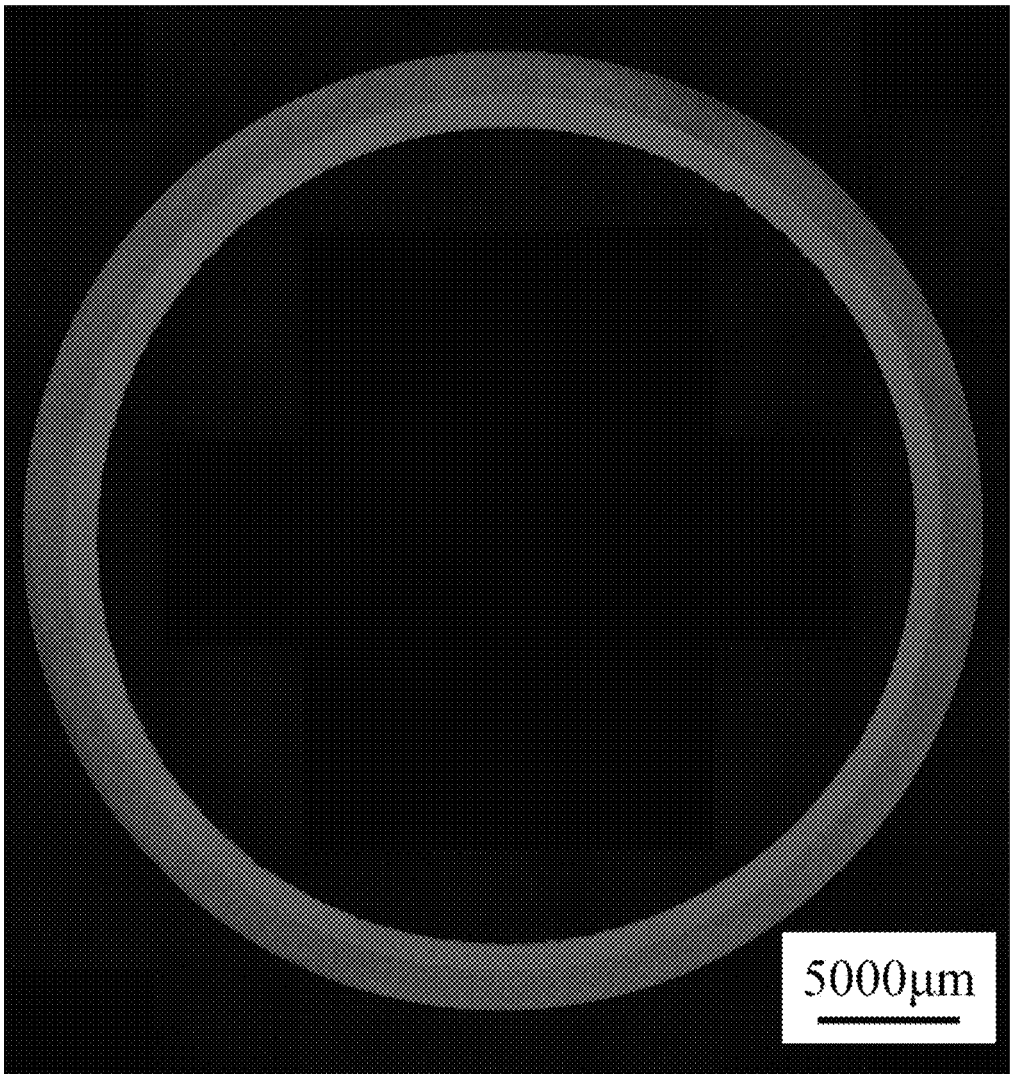
FIG. 10 is a cross-sectional bonding interface diagram of the bimetallic seamless composite pipe prepared in Embodiment 1 of the disclosure.
Figure 11:
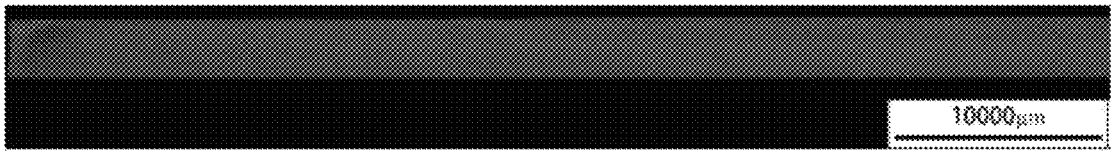
FIG. 11 is a longitudinal section bonding interface diagram of the bimetallic seamless composite pipe prepared in Embodiment 1 of the disclosure.
Figure 12:
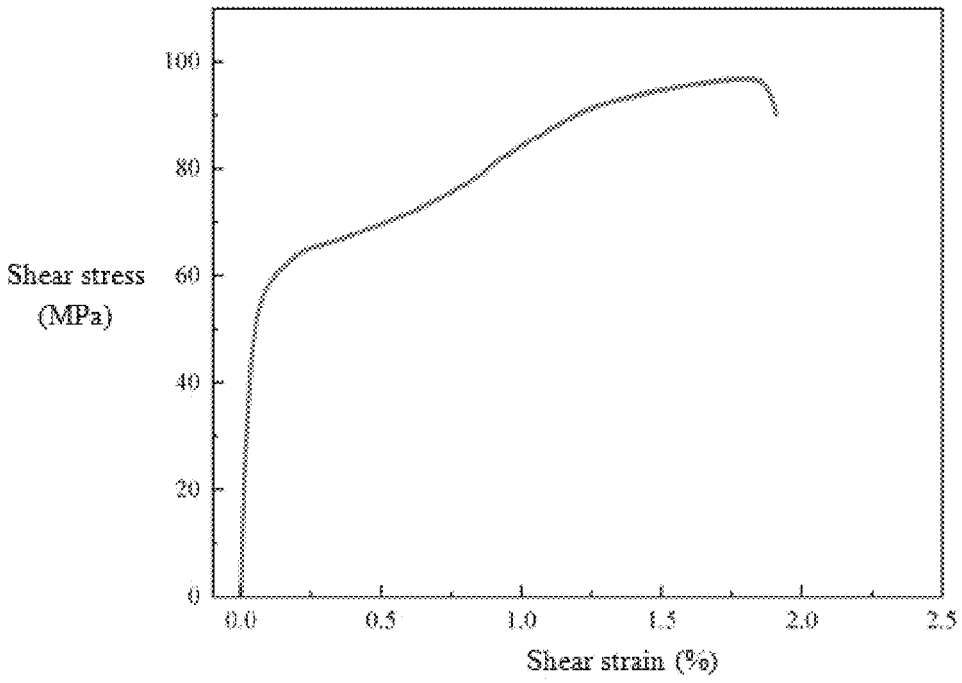
FIG. 12 is a longitudinal section tension-shear test curve of the bimetallic seamless composite pipe prepared in Embodiment 1 of the disclosure.

A physical diagram of the bimetallic seamless composite pipe prepared in this embodiment is shown in FIG. 9. A cross-sectional bonding interface diagram of the bimetallic seamless composite pipe is shown in FIG. 10. A longitudinal section bonding interface diagram of the bimetallic seamless composite pipe is shown in FIG. 11. A longitudinal section tension-shear test curve of the bimetallic seamless composite pipe is shown in FIG. 12.

The method of this embodiment greatly improves the production efficiency of the composite pipe. In FIG. 10, an inner ring is the cladding pipe 1060 aluminum alloy, and an outer ring is the base pipe 6061 aluminum alloy. The bonding interface of the two aluminum alloys is evenly distributed in a cross-sectional direction of the pipe, and there is no obvious bulge or damage. It may be seen from FIG. 11 that the lower metal is 1060 aluminum alloy and the upper metal is 6061 aluminum alloy, and the bonding interface between the two metals is evenly distributed. The wall thickness of the base pipe 6061 aluminum alloy is about 1.4 mm, and the wall thickness of the cladding pipe 1060 aluminum alloy is about 1.1 mm. It may be seen from FIG. 12 that a bonding strength at the interface of the extruded 6061 aluminum alloy/1060 aluminum alloy may reach over 90 MPa, so the bonding effect is good.

Embodiment 2

An efficient preparation method of 5052 aluminum alloy/AZ31B magnesium alloy bimetallic seamless metal composite pipe is as follows.

(1) 5052 aluminum alloy is selected as a base pipe blank and AZ31B magnesium alloy is selected as a cladding pipe blank. An extruder with an inner diameter of an extrusion cylinder $D_1$=95 mm is selected as extrusion equipment, and a wall thickness of a base pipe of an extruded composite pipe $b_1$=1.5 mm, a wall thickness of a cladding pipe $b_2$=1 mm, an elastic modulus $E_1$ of 5052 aluminum alloy (base pipe blank)=69.3 GPa, and an elastic modulus $E_2$ of AZ31B aluminum alloy (cladding pipe blank)=45 GPa, $E_2-E_1<-10$ GPa, and a supplementary wall thickness K=0.5 mm is selected, $b_{03}=b_2+K$=1.5 mm.

(2) According to the inner diameter $D_1$ of the extrusion cylinder, cylindrical blanks of 5052 aluminum alloy and AZ31B magnesium alloy with a diameter $D_0$ of 92 mm and an original height $L_0$ of 150 mm are selected.

(3) According to a core rod diameter $D_2$=29.5 mm, centers of 5052 aluminum alloy and AZ31B aluminum alloy cylindrical ingots are pre-drilled, with a drilling diameter of 28 mm, a machining error of ±0.21 mm and an aperture deviation of ±0.01 mm, and an outer surface of a 5052 aluminum alloy cylindrical ingot is turned, with a turning depth of 1±0.21 mm and the surface smoothness meeting the Ra0.2 standard of GB/T 1031-2009.

(4) Three-dimensional dimensions of extrusion related components such as extrusion die, extrusion cylinder and extrusion pad are measured, and three-dimensional modeling of the extrusion related components is carried out. Three-dimensional models are combined, and the combined three-dimensional model is used to extrude a single metal seamless pipe. According to extrusion simulation results, the metal flow situations in the extrusion process, especially flow velocities and flow directions of the core metal and the edge metal, are analyzed, and a shape of an assembly interface between the base pipe blank and the cladding pipe blank is determined.

(5) According to the step (4), the base pipe blank and the cladding pipe blank are further machined (the machining tolerance meets the GB/T 1800.1-2020 IT12 grade, and the surface smoothness meets the Ra0.2 standard of GB/T 1031-2009), where one end of the cladding pipe blank needs to be left with a sufficient length $l_{01}$ (a length of a determined wall thickness area)=0.1 $L_0$ (an original height of the cylindrical ingots)=15 mm, and a pipe blank thickness of the determined wall thickness area of the cladding pipe blank $b_{03}$=1.5 mm, and an outer surface of the cladding pipe blank is machined in the remaining unprocessed area according to the shape determined by the simulation results. An end thickness of a non-determined wall thickness area of the base pipe blank (a minimum wall thickness of the base pipe blank of the bimetallic composite pipe) is $b_{01}$=2 mm, and an end thickness of a non-determined wall thickness area of the cladding pipe blank (a maximum wall thickness of the cladding pipe blank of the bimetallic composite pipe) is $b_{02}$=27 mm. An inside of the cladding pipe blank is finely turned according to the core rod diameter $D_2$, and an inner diameter do of the cladding pipe blank is 32 mm, and an inner hole of the base pipe blank is further machined. A machining size is consistent with the outer surface of the cladding pipe (a gap between the base pipe blank and the cladding pipe blank is 0.05 mm). After machining, an outer diameter of the base pipe $D_0$=90 mm, and the machining error is ±0.21 mm.

(6) Polishing: an inner surface of the base pipe blank and the outer surface of the cladding pipe blank are further polished by a grinder with a wire brush, so as to remove residual oxide films on the surfaces and scratches and tiny gullies caused in the machining process, and a surface cleaning thickness is 0.3 mm.

(7) Cleaning: an air gun is used to clean metal chips on the polished surfaces of the pipe blanks, and the pipe blanks are put into alkali liquor for cleaning, so as to remove greasy dirt attached to the surfaces of the pipe blanks during machining.

(8) The base pipe blank and the cladding pipe blank which have been machined, polished and cleaned are assembled to form a bimetallic seamless composite pipe blank.

(9) The bimetallic seamless composite pipe blank obtained in the step (8) is put into a heating furnace for a stress relief annealing treatment, where a temperature of the stress relief annealing treatment is 280° C., and a duration is 2 h, and is cooled after stress relief annealing (cooling mode is furnace cooling) to eliminate an internal stress stored in the composite pipe blank during machining and polishing.

(10) The stress-relieved annealed composite pipe blank is heated and insulated, and a heating temperature is 420° C. (about 0.76 times the melting point of 5052 aluminum alloy (554° C.)), and an insulation duration is $T_1$=177 min ($T_1=(1.5+0.01\times(D_0-50))\times D_0$).

(11) The insulated composite pipe blank is assembled with the core rod, graphite-based grease is coated on the core rod to facilitate the core rod demoulding, a non-determined wall thickness area of the composite pipe blank is in contact with an end of the core rod, and the combined composite pipe blank and the core rod are put into the extruder for extrusion. During extrusion, a die temperature is 400° C., a maximum extrusion pressure is 20 MPa, an extrusion speed is 1 mm/s, a die hole size is 34.5 mm, and an extrusion ratio $\lambda=(47.5^2-16^2)\div(17.25^2-14.75^2)=25.0$. After extrusion, the extruded 5052 aluminum alloy/AZ31B magnesium alloy composite pipe is quickly put into a water tank for cooling in order to prevent the poor deformability of AZ31B magnesium alloy and the cracking of the base pipe wall during cooling. Finally, a composite pipe fitting with an outer diameter D=34.5 mm, an inner diameter d=29.5 mm, a wall thickness of a base pipe fitting $b_1$=1.5 mm and a wall thickness of a cladding pipe fitting $b_2$=1 mm, and a bimetallic seamless composite pipe with a length L of about 170 cm may be obtained (the length L of the extruded bimetallic seamless composite pipe is determined by the original blank length).

Embodiment 3

An efficient preparation method of 6061 aluminum alloy/T2 copper bimetallic seamless metal composite pipe is as follows.

(1) 6061 aluminum alloy is selected as a base pipe blank and T2 copper is selected as a cladding pipe blank. An extruder with an inner diameter of an extrusion cylinder $D_1$=95 mm is selected as extrusion equipment, and a wall thickness of a base pipe of an extruded composite pipe $b_1$=2 mm, a wall thickness of a cladding pipe $b_2$=0.5 mm, an elastic modulus $E_1$ of 6061 aluminum alloy (base pipe blank)=68.9 GPa, and an elastic modulus $E_2$ of T2 copper (cladding pipe blank)=100 GPa, $E_2-E_1>0$ GPa, and a supplementary wall thickness K=0.2 mm is selected, $b_{03}=b_2+K=0.7$ mm.

(2) According to the inner diameter $D_1$ of the extrusion cylinder, cylindrical blanks of 6061 aluminum alloy and T2 copper with a diameter $D_0$ of 92 mm and an original height $L_0$ of 100 mm are selected.

(3) According to a core rod diameter $D_2$=29.5 mm, centers of 6061 aluminum alloy and AZ31B magnesium alloy cylindrical ingots are pre-drilled, with a drilling diameter of 28 mm, a machining error of ±0.21 mm and an aperture deviation of ±0.01 mm, and an outer surface of an AZ31B magnesium alloy cylindrical ingot is turned, with a turning depth of 1±0.21 mm and the surface smoothness meeting the Ra0.2 standard of GB/T 1031-2009.

(4) Three-dimensional dimensions of extrusion related components such as extrusion die, extrusion cylinder and extrusion pad are measured, and three-dimensional modeling of the extrusion related components is carried out. Three-dimensional models are combined, and the combined three-dimensional model is used to extrude a single metal seamless pipe. According to extrusion simulation results, the metal flow situations in the extrusion process, especially flow velocities and flow directions of the core metal and the edge metal, are analyzed, and a shape of an assembly interface between the base pipe blank and the cladding pipe blank is determined.

(5) According to the step (4), the base pipe blank and the cladding pipe blank are further machined (the machining tolerance meets the GB/T 1800.1-2020 IT12 grade, and the surface smoothness meets the Ra0.2 standard of GB/T 1031-2009), where one end of the cladding pipe blank needs to be left with a sufficient length $l_{01}$ (a length of a determined wall thickness area)=0.1 $L_0$ (an original height of the cylindrical ingots)=10 mm, and a pipe blank thickness of the determined wall thickness area of the cladding pipe blank $b_{03}$=0.7 mm, and an outer surface of the cladding pipe blank is machined in the remaining unprocessed area according to the shape determined by the simulation results. An end thickness of a non-determined wall thickness area of the base pipe blank (a minimum wall thickness of the base pipe blank of the bimetallic composite pipe) is $b_{01}$=10 mm, and an end thickness of a non-determined wall thickness area of the cladding pipe blank (a maximum wall thickness of the cladding pipe blank of the bimetallic composite pipe) is $b_{02}$=19 mm. An inside of the cladding pipe blank is finely turned according to the core rod diameter $D_2$, and an inner diameter do of the cladding pipe blank is 32 mm, and an inner hole of the base pipe blank is further machined. A machining size is consistent with the outer surface of the cladding pipe (a gap between the base pipe blank and the cladding pipe blank is 0.05 mm). After machining, an outer diameter of the base pipe $D_0$=90 mm, and the machining error is ±0.21 mm.

(6) Polishing: an inner surface of the base pipe blank and the outer surface of the cladding pipe blank are further polished by a grinder with a wire brush, so as to remove residual oxide films on the surfaces and scratches and tiny gullies caused in the machining process, and a surface cleaning thickness is 0.2 mm.

(7) Cleaning: an air gun is used to clean metal chips on the polished surfaces of the pipe blanks, and the pipe blanks are put into alkali liquor for cleaning, so as to remove greasy dirt attached to the surfaces of the pipe blanks during machining.

(8) The base pipe blank and the cladding pipe blank which have been machined, polished and cleaned are assembled to form a bimetallic seamless composite pipe blank.

(9) The bimetallic seamless composite pipe blank obtained in the step (8) is put into a heating furnace for a stress relief annealing treatment, where a temperature of the stress relief annealing treatment is 350° C., and a duration is 2 h, and is cooled after stress relief annealing (cooling mode is furnace cooling) to eliminate an internal stress stored in the composite pipe blank during machining and polishing.

(10) The stress-relieved annealed composite pipe blank is heated and insulated, and a heating temperature is 450° C. (about 0.77 times the melting point of 6061 aluminum alloy (585° C.)), and an insulation duration is $T_1$=177 min ($T_1=(1.5+0.01\times(D_0-50))\times D_0$).

(11) The insulated composite pipe blank is assembled with the core rod, graphite-based grease is coated on the core rod to facilitate the core rod demoulding, a non-determined wall thickness area of the composite pipe blank is in contact with an end of the core rod, and the combined composite pipe blank and the core rod are put into the extruder for extrusion. During extrusion, a die temperature is 450° C., a maximum extrusion pressure is 20 MPa, an extrusion speed is 5 mm/s, a die hole size is 34.5 mm, and an extrusion ratio $\lambda=(47.5^2-16^2)\div(17.25^2-14.75^2)=25.0$. After extrusion, the combined composite pipe blank and the core rod are air-cooled to a room temperature. Finally, a bimetallic seamless composite pipe with an outer diameter D=34.5 mm, an inner diameter d=29.5 mm, a wall thickness of a base pipe fitting $b_1$=2 mm, a wall thickness of a cladding pipe fitting $b_2$=0.5 meters (m), and a length L of about 170 cm may be obtained (the length L of the extruded bimetallic seamless composite pipe is determined by the original blank length).

TABLE 1

Mechanical properties of different composite pipes after extrusion

| Parameter | Length (cm) | Tension-shear property (MPa) | Ultimate tensile strength (MPa) |
|---|---|---|---|
| Embodiment 1 (6060/1060) | 170 | Over 90 | Over 175 |
| Embodiment 2 (5052/AZ31B) | 170 | Over 30 | Over 180 |
| Embodiment 3 (6061/T2) | 170 | Over 25 | Over 150 |

Comparative Example 1

Compared with Embodiment 1, the only difference is that the extrusion ratio of the base pipe blank to the cladding pipe blank is changed.

Compared with the published related patents, the disclosure has a larger extrusion ratio in the extrusion process. Although the extrusion ratio may be reduced to about 5, a composite pipe with smooth appearance and good mechanical properties may be manufactured, but the length and the wall thickness of the extruded composite pipe may be greatly limited. The length of the blanks used in the disclosure is only 10 centimeters (cm), the extruded composite pipe is 170 cm, so the conversion rate of a finished product is 17 times in length.

On the other hand, a composite pipe extruded with a small extrusion ratio (about 5) in this comparative example has a similar effect to ring rolling, which mainly means that a composite pipe blank passes through an extrusion die, and then the extrusion die exerts a radial force on the blank to combine the two materials. The length of a produced composite pipe is close to the length of the original blank, so the advantages of continuous and efficient extrusion process may not be embodied.

Comparative Example 2

Compared with Embodiment 1, the only difference is that the assembly mode of the base pipe blank and the cladding pipe blank is changed from the assembly mode with a certain shape to a form that the assembly interface between the base pipe blank and the cladding pipe blank is a straight line, the outer diameter of the cladding pipe blank is changed to 35 mm, and the inner diameter of the base pipe blank is also designed to be 35 mm, and an assembly gap of 0.1 mm is left between the two layers of pipe blanks during processing.

Under the same extrusion parameters, the cladding pipe blank is too thin, and there is obvious damage near a joint surface of the two materials, which is not conducive to the study of mechanical properties and continuous production.

Comparative Example 3

Compared with Embodiment 2, the difference is only that the parameter conditions of extrusion are changed.

When extruding a 5052/AZ31B composite pipe, if the extrusion speed is increased to 5 mm/s to increase the output per unit time, obvious surface cracks may appear on the inner wall of the extruded pipe, which is not conducive to further processing of the composite pipe, on the other hand, the subsequent sales and use will also be affected accordingly.

The above-mentioned embodiments only describe preferred modes of the disclosure, and $d_0$ not limit a scope of the disclosure. Under a premise of not departing from a design spirit of the disclosure, various modifications and improvements made by ordinary technicians in the field to the technical scheme of the disclosure shall fall within a protection scope determined by claims of the disclosure.

What is claimed is:

1. An efficient preparation method of a bimetallic seamless composite pipe, comprising following steps:

(1) material selection: materials of a base pipe blank and a cladding pipe blank are different, and a material of the base pipe blank is 6061 aluminum alloy or 5052 aluminum alloy; a material of the cladding pipe blank is 1060 aluminum alloy, AZ31B magnesium alloy or T2 copper;

(2) sheathing the base pipe blank on the cladding pipe blank to obtain a composite pipe blank;

selecting an outer diameter $D_0$ of the composite pipe blank according to an inner diameter $D_1$ of an extrusion cylinder, wherein a selection rule is $D_0=D_1-(0.3\text{-}10)$ mm, and units of $D_1$ and $D_0$ are mm;

selecting an inner diameter do of the composite pipe blank according to a diameter $D_2$ of a core rod, wherein a selection rule is $d_0=D_2+(1\text{-}3)$ mm;

(3) a shape of an assembly interface between the base pipe blank and the cladding pipe blank: an outer contour of the cladding pipe blank is processed from a big end to a small end in transition, an outer diameter of the big end is 1.5-2.6 times an outer diameter of the small end, and an inner contour of the cladding pipe blank is cylindrical;

an outer contour of the base pipe blank is cylindrical, an inner contour of the base pipe blank is matched with the outer contour of the cladding pipe blank, and there is a gap of 0.05 mm between the inner contour of the base pipe blank and the outer contour of the cladding pipe blank;

(4) calculating a wall thickness $b_{03}$ of the small end of the cladding pipe blank according to a wall thickness $b_1$ of a formed base pipe wall, a wall thickness $b_2$ of a cladding pipe wall, and a difference between an elastic modulus $E_2$ of a cladding pipe material and an elastic modulus $E_1$ of a base pipe material, wherein $b_{03}=b_2+K$, and K is a supplementary wall thickness of the cladding pipe blank; when $E_2-E_1<-10$ GPa, K=0.5-1 mm; when $-10$ GPa$\leq E_2-E_{1\leq 0}$ GPa, K=0.2-0.5 mm; and when $E_2-E_1>0$ GPa, K=0-0.2 mm; and units of $E_1$ and $E_2$ are GPa;

(5) carrying out a stress relief annealing treatment on the composite pipe blank, wherein a temperature of the stress relief annealing treatment is 280-350° C., and a duration is 2 h; and (6) heating the composite pipe blank obtained in step (2) after the stress relief annealing treatment to a hot working window temperature, then sheathing the composite pipe blank onto the core rod of the extrusion cylinder after an insulation treatment, and then extruding the composite pipe blank along an axial direction of the extrusion cylinder to obtain a bimetallic seamless composite pipe;

the hot working window temperature is 0.75-0.95 times of a melting point of a metal;

an outer diameter of a composite pipe blank is defined as $D_0$ mm, and when $D_0<50$ mm, an insulation duration for the insulation treatment is $(1.5\times D_0)$ min; when 50 mm$<D_0<$100 mm, the insulation duration for the insulation treatment is $[(1.5+0.01\times(D_0-50))\times D_0]$ min; when $D_0>100$ mm, the insulation duration for the insulation treatment is $(2.5\times D_0)$ min;

a temperature for the extrusion is a same as the temperature for the insulation treatment; an extrusion ratio of the extrusion is 25, and an extrusion speed is 1-5 mm/s;

units of $D_1$, $D_2$, $D_0$, $d_0$, $b_1$, $b_2$, $b_{03}$ and K are all mm.

2. The preparation method according to claim 1, wherein a discharge end for the extrusion is a side being the small end of the outer contour of the cladding pipe blank.

* * * * *